US006016855A

United States Patent [19]

Morey

[11] Patent Number: 6,016,855

[45] Date of Patent: Jan. 25, 2000

[54] HOOD ASSEMBLY FOR A WOOD CHIPPER

[75] Inventor: Michael Boyd Morey, Shepherd, Mich.

[73] Assignee: Tramor, Inc., Remus, Mich.

[21] Appl. No.: 09/262,252

[22] Filed: Mar. 4, 1999

[51] Int. Cl.[7] ..... B27C 1/00; B02C 21/02; B02C 13/00

[52] U.S. Cl. ..... 144/162.1; 144/176; 144/373; 241/92; 241/101.76; 241/188.1; 241/301

[58] Field of Search ..... 144/162.1, 172–174, 144/176, 208.1, 208.7, 241, 369, 373; 241/79.2, 92, 93, 94, 298, 194, 195, 198, 101.72, 101.74, 101.76, 101.78, 189.1, 188.1, 301, 296

[56] References Cited

U.S. PATENT DOCUMENTS

| | | | |
|---|---|---|---|
| 190,675 | 5/1877 | Gaines . | |
| 589,236 | 8/1897 | Williams . | |
| 604,283 | 5/1898 | Albrecht . | |
| 1,266,894 | 5/1918 | Williams . | |
| 1,713,507 | 5/1929 | Ammon . | |
| 1,752,290 | 4/1930 | Ammon . | |
| 1,889,129 | 11/1932 | Nielsen . | |
| 1,959,465 | 5/1934 | Dryfoos . | |
| 2,026,790 | 1/1936 | Mankoff . | |
| 2,128,194 | 8/1938 | Sheldon . | |
| 2,244,577 | 6/1941 | Schreiber . | |
| 2,318,219 | 5/1943 | Harris | 83/11 |
| 2,392,958 | 1/1946 | Tice | 241/55 |
| 2,658,318 | 11/1953 | Miller . | |
| 2,663,505 | 12/1953 | Sennholtz | 241/197 |
| 2,678,169 | 5/1954 | Tullis . | |
| 2,710,635 | 6/1955 | Alexander | 144/162 |
| 2,837,290 | 6/1958 | Nagel . | |
| 2,863,476 | 12/1958 | Clark | 144/172 |
| 2,864,420 | 12/1958 | Schmidt | 146/106 |
| 3,030,037 | 4/1962 | Raetz . | |
| 3,069,101 | 12/1962 | Wexell . | |
| 3,254,687 | 6/1966 | Tertyshnikov | 146/79 |
| 3,276,700 | 10/1966 | Eklund . | |
| 3,367,585 | 2/1968 | Ratkowski | 241/197 |
| 3,436,028 | 4/1969 | Koehnen et al. | 241/186 |
| 3,509,924 | 5/1970 | Newhouse, Jr. | 146/70.1 |
| 3,635,410 | 1/1972 | Smith . | |
| 3,642,214 | 2/1972 | Blackwell, Jr. | 241/191 |
| 3,844,494 | 10/1974 | Hightower | 241/197 |
| 3,907,016 | 9/1975 | Nicholson et al. | 144/172 |
| 3,907,216 | 9/1975 | MacKissic et al. . | |
| 3,936,004 | 2/1976 | Graf et al. . | |
| 4,074,594 | 2/1978 | Dall et al. | 76/101 |
| 4,077,450 | 3/1978 | Ackerman | 144/172 |
| 4,117,985 | 10/1978 | Lazareck | 241/197 |
| 4,129,260 | 12/1978 | Baker | 241/46 |
| 4,146,184 | 3/1979 | Whitney | 241/73 |
| 4,162,769 | 7/1979 | Lapointe | 241/68 |
| 4,168,035 | 9/1979 | Palm et al. | 241/81 |
| 4,504,019 | 3/1985 | Newell et al. | 241/73 |
| 4,527,604 | 7/1985 | Everett | 144/176 |
| 4,544,104 | 10/1985 | Carlsson | 241/101.76 |
| 4,702,424 | 10/1987 | Widlak | 241/101.7 |
| 4,717,083 | 1/1988 | Quast et al. | 241/197 |
| 4,850,406 | 7/1989 | Krautzberger | 144/230 |
| 4,872,500 | 10/1989 | Duffey et al. | 164/34 |
| 4,915,310 | 4/1990 | Stelk | 241/197 |
| 4,917,314 | 4/1990 | Manschwetus | 241/194 |
| 4,922,977 | 5/1990 | Colton et al. | 144/230 |
| 4,967,969 | 11/1990 | Griffith, III | 241/93 |
| 4,982,904 | 1/1991 | Greiner | 241/73 |
| 5,005,620 | 4/1991 | Morey . | |
| 5,042,727 | 8/1991 | Plante | 241/101.76 |
| 5,044,567 | 9/1991 | Hte et al. | 241/73 |
| 5,078,328 | 1/1992 | Willingham | 241/101.76 |
| 5,114,085 | 5/1992 | Inui | 241/195 |
| 5,205,496 | 4/1993 | O'Donnell et al. | 241/34 |
| 5,209,278 | 5/1993 | Carpenter et al. | 144/230 |
| 5,285,974 | 2/1994 | Cesarini | 241/194 |
| 5,358,189 | 10/1994 | Vandermolen . | |
| 5,362,004 | 11/1994 | Bateman | 241/290 |
| 5,372,316 | 12/1994 | Bateman | 241/191 |
| 5,377,919 | 1/1995 | Rogers et al. | 241/189.2 |
| 5,413,286 | 5/1995 | Bateman | 241/190 |
| 5,474,239 | 12/1995 | Williams, Jr. et al. | 241/73 |
| 5,526,988 | 6/1996 | Rine | 241/23 |
| 5,692,548 | 12/1997 | Bouwers et al. . | |

*Primary Examiner*—W. Donald Bray
*Attorney, Agent, or Firm*—Bliss McGlynn, P.C.

[57] ABSTRACT

A hood assembly for wood chipper includes a housing and a cutting assembly partially disposed within the housing.

The hood assembly also includes a first hood partially enclosing the cutting assembly and fixedly connected to the housing and a second hood pivotally connected to the housing and having a closed position covering the cutting assembly and an open position extending away from the cutting assembly. The hood assembly further includes a removable hood pin to secure the first and second hoods together in the closed position and a hood pin plunger assembly connected to the first hood and cooperating with the hood pin and having a bent handle to allow an operator to actuate the hood pin plunger assembly to remove the hood pin after the cutting assembly has stopped rotating to move the second hood to the open position.

20 Claims, 3 Drawing Sheets

HOOD ASSEMBLY FOR A WOOD CHIPPER

BACKGROUND OF THE INVENTION

1. Field of the Invention

The present invention relates generally to wood chippers and, more particularly, to a hood assembly for a wood chipper.

2. Description of the Related Art

It is known to provide a wood chipper for chipping wood such as brush, branches and the like to produce wood chips. One type of wood chipper known in the art includes a cutting assembly having a rotatable disc with at least one knife or blade for chipping the wood entering the wood chipper and reducing it to wood chips. Typically, the wood chipper includes a hood assembly surrounding the cutting assembly and having a stationary lower housing and an stationary upper half hood connected to the lower housing and a movable upper half hood hinged to the lower housing for allowing access to the cutting assembly. The hood assembly includes a removable hood pin connecting the upper half hoods together and a locking device to prevent an operator from unintentionally removing the hood pin and opening the hood assembly to allow access to the cutting assembly.

Although this type of hood assembly has worked well, it is desirable to prevent the operator from opening the hood assembly while the cutting assembly is rotating under normal or extreme operating conditions. Therefore, there is a preferred need in the art to provide a hood assembly for a wood chipper to prevent access by an operator to the cutting assembly while the cutting assembly is rotating.

SUMMARY OF THE INVENTION

Accordingly, the present invention is a hood assembly for a wood chipper including a lower housing and a rotatable cutting assembly partially disposed within the lower housing. The hood assembly also includes a first half hood partially covering the cutting assembly and fixedly connected to the lower housing. The hood assembly includes a second half hood pivotally connected to the lower housing and having a closed position covering the cutting assembly and an open position extending away from the cutting assembly. The hood assembly further includes a removable hood pin to connect the first half hood and second half hood together in the closed position. The hood assembly includes a hood pin plunger assembly connected to the first half hood for cooperating with the hood pin and having a bent handle to allow an operator to actuate the hood pin plunger assembly to remove the hood pin after the cutting assembly has stopped rotating to move the second half hood to the open position.

One advantage of the present invention is that a new and improved hood assembly is provided for a wood chipper. Another advantage of the present invention is that the hood assembly is provided with a hood pin plunger assembly to resist opening of the hood assembly by an operator while the cutting assembly is rotating. A further advantage of the present invention is that the hood assembly has a bent handle to allow an operator to actuate the hood pin plunger assembly to allow an operator to remove the hood pin and access the cutting assembly only once the cutting assembly has stopped rotating.

Other features and advantages of the present invention will be readily appreciated as the same becomes better understood after reading the subsequent description when taken in conjunction with the accompanying drawings.

DESCRIPTION OF THE PREFERRED EMBODIMENT(S)

Figure 1:
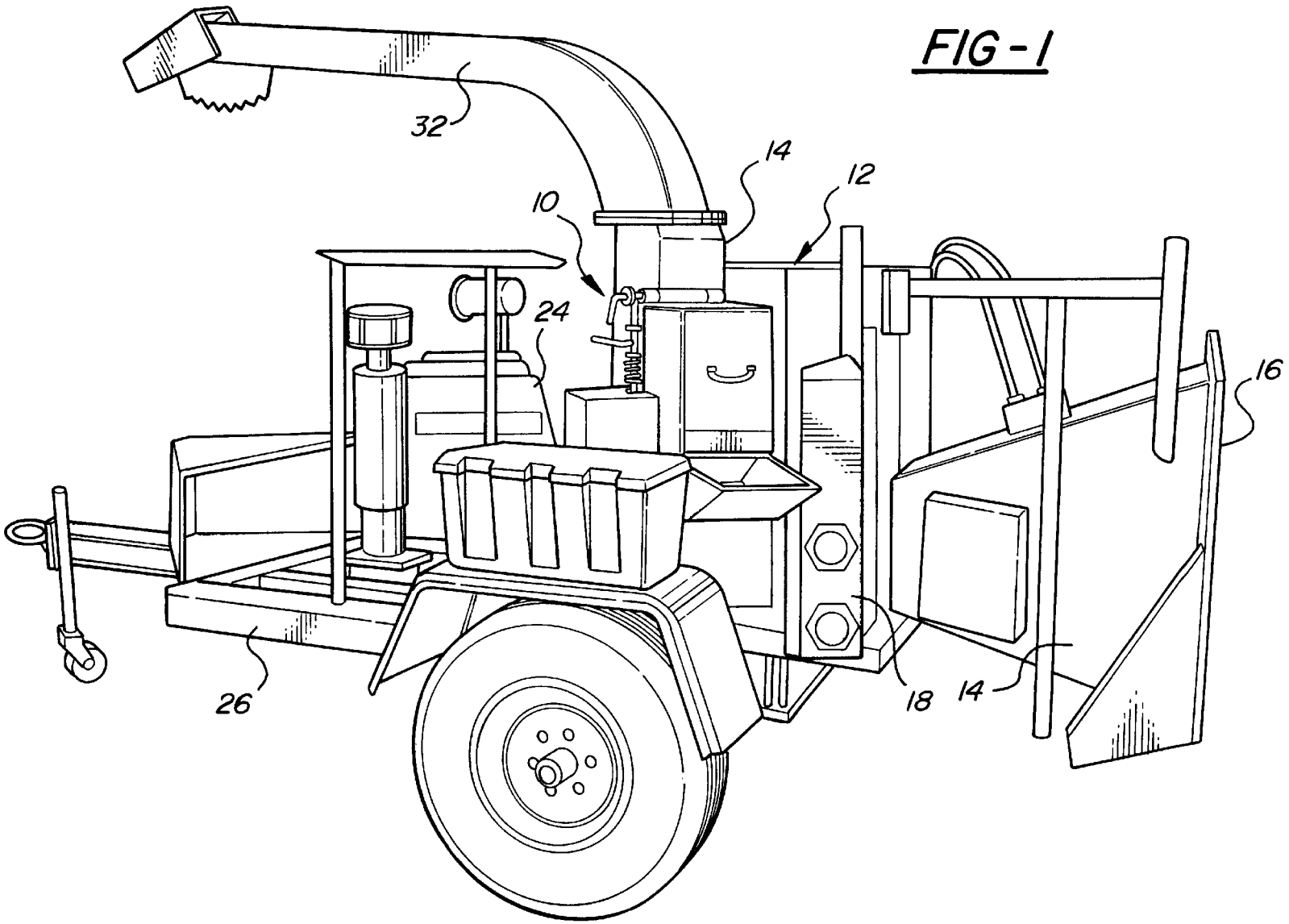
FIG. 1 is a perspective view of a hood assembly, according to the present invention, illustrated in operational relationship with a wood chipper.
Figure 2:
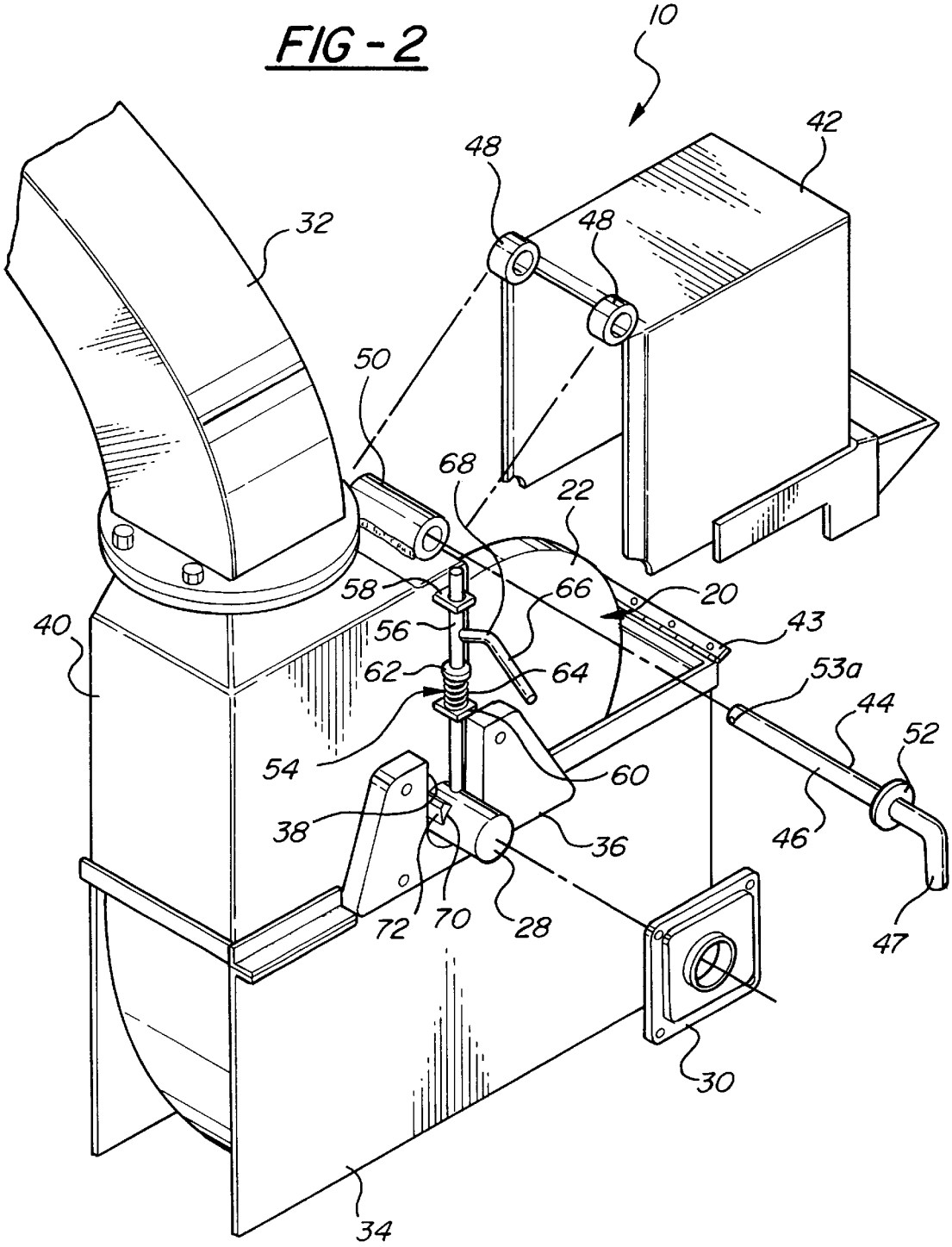
FIG. 2 is a perspective exploded view of a portion of the hood assembly of FIG. 1.
Figure 4:
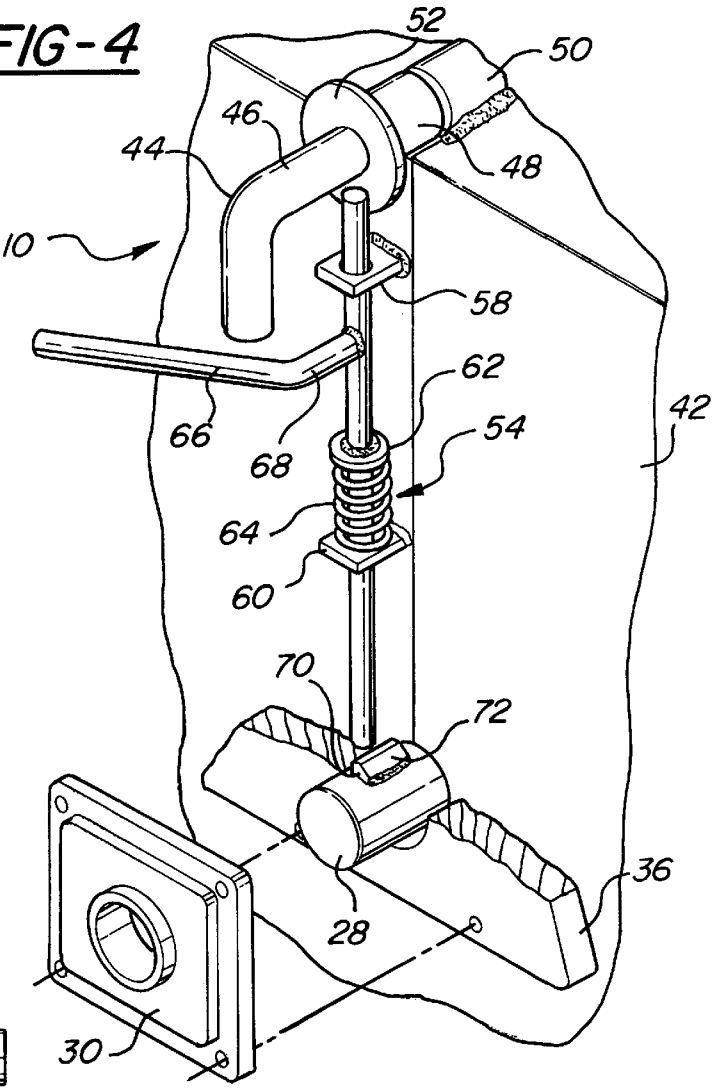
FIG. 4 is a perspective view of a portion of the hood assembly of FIG. 1.
Figure 3:
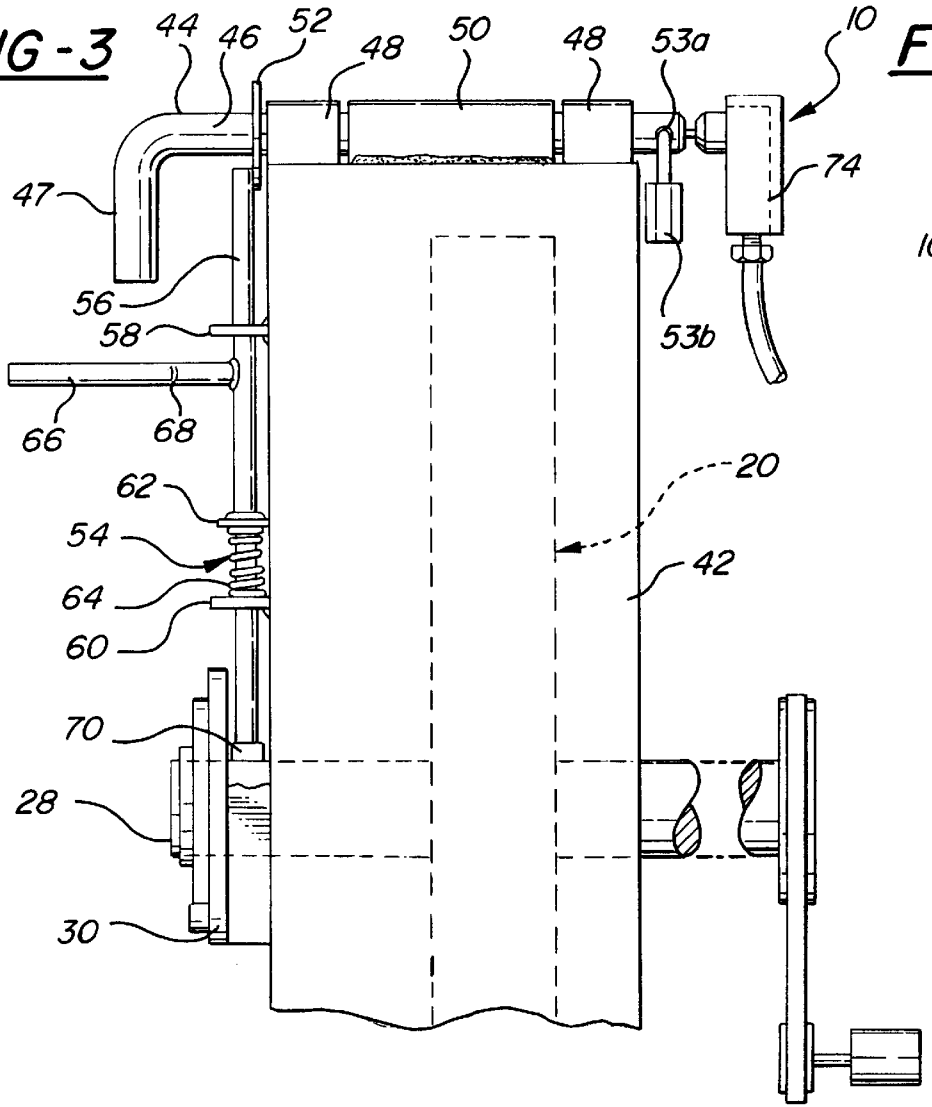
FIG. 3 is an elevational view of the hood assembly of FIG. 1.

Referring now to the drawings and in particular FIGS. 1 and 2, one embodiment of a hood assembly 10, according to the present invention, is shown for a wood chipper, generally indicated at 12. The wood chipper 12 includes an infeed chute assembly 14 having an inlet 16 to allow wood material to enter the wood chipper 12. The wood chipper 12 also includes a feed wheel assembly 18 disposed adjacent to the infeed chute assembly 14 and a cutting assembly 20 for rotation about a horizontal axis adjacent to the feed wheel assembly 18. The feed wheel assembly 18 includes rotatable upper, lower or vertical feed wheels (not shown) for pulling and pushing the wood material from the infeed chute assembly 14 to the cutting assembly 20. The cutting assembly 20 includes a rotatable disc 22 having a plurality of blades (not shown) operatively connected to the disc 22 for chipping the wood material. It should be appreciated that the feed wheel assembly 18 and cutting assembly 20 are conventional and known in the art.

The wood chipper 12 includes an engine 24 mounted on a frame 26 and coupled to the feed wheel assembly 18 and cutting assembly 20 by suitable means to cause rotation of the feed wheels and disc 22. The wood chipper 12 includes a rotatable shaft 28 operatively connected to the disc 22 of the cutting assembly 20 and a pulley (not shown) disposed about one end of the shaft 28. The shaft 28 is rotatably mounted to the hood assembly 10 by suitable means such as bearings 30. The wood chipper 12 also includes a rotatable shaft (not shown) operatively connected to the engine 24 and a pulley (not shown) disposed about the shaft (not shown). The wood chipper 12 further includes a belt or belts (not shown) disposed over and interconnecting the pulleys. It should be appreciated that the engine 24 rotates the shaft and pulley, in turn, rotating the belt, pulley and shaft 28, in turn, rotating the disc 22 of the cutting assembly 20 and feed wheels of the feed wheel assembly 18.

The wood chipper 12 includes an outlet or discharge chute 32 operatively connected to the hood assembly 10. The discharge chute 32 is generally tubular and may be circular or rectangular in cross-sectional shape. The discharge chute 32 extends upwardly and forwardly. It should be appreciated that the discharge chute 32 may have any suitable cross-sectional shape.

Referring to FIGS. 1 through 4, the wood chipper 12 includes the hood assembly 10 to surround and enclose the cutting assembly 20. The hood assembly 10 includes a lower housing 34 having a generally rectangular shape with a generally inverted U shape cross-section to enclose a lower portion of the cutting assembly 20. The lower housing 34 is stationary and connected to the feed wheel assembly 18 by suitable means such as welding. The lower housing 34 has an inlet (not shown) on one side to receive wood material from the feed wheel assembly 18. The lower housing 34 has a pair of opposed saddle members 36 extending upwardly. The saddle members 36 have a U-shaped aperture 38 extending therethrough to receive the shaft 28. The bearings 30 are secured to the saddle members 36 by suitable means such as fasteners (not shown). It should be appreciated that the lower housing 34 may have any suitable cross-sectional shape.

The hood assembly 10 also includes a stationary upper half hood or first hood 40 fixedly connected to the lower housing 34 by suitable means such as fasteners (not shown). The first hood 40 is generally rectangular in shape with a generally inverted U shape cross-section to enclose or cover approximately half of an upper portion of the cutting assembly 20. The first hood 40 has an outlet at an upper end to allow chipped wood material to exit the cutting assembly 20 and pass through the discharge chute 32. The hood assembly 10 includes a movable upper hood half or second hood 42 pivotally connected by a hinge 43 to the lower housing 34 and having a closed position covering the cutting assembly 20 and an open position extending away from the cutting assembly 20. The second hood 42 is generally rectangular in shape with a generally inverted U shape cross-section to enclose or cover approximately the other half of the upper portion of the cutting assembly 20. It should be appreciated that the first hood 40 and second hood 42 may have any suitable cross-sectional shape.

The hood assembly 10 includes a removable hood pin 44 to connect the first and second hoods 40 and 42 together in the closed position. The hood pin 44 has a general L shape with a relatively long portion 46 and a relatively short portion 47. The relatively long portion 46 extends through a pair of sleeves 48 spaced transversely on the second hood 42 and a sleeve 50 on the first hood 40 disposed between the sleeves 48. The hood pin 44 is a generally cylindrical and made of a metal material such as steel. The hood pin 44 has a flange 52 extending outwardly from its relatively long portion 46 near the relatively short portion 47 for a function to be described. The hood pin 44 has an aperture 53*a* extending diametrically through one end of the relatively long portion 46 to allow a locking device such as a padlock 53*b* to pass therethrough. It should be appreciated that the hood pin 44 may have any suitable shape and the connection for the hood pin 44 may also have any suitable shape.

The hood assembly 10 also includes a hood pin plunger assembly, generally indicated as 54, cooperating with the hood pin 44 and shaft 28 to prevent the second hood 42 from opening or being moved to the open position while the cutting assembly 20 is rotating. The hood pin plunger assembly 54 includes a lock pin 56, which is generally cylindrical in shape with a circular cross-section. The lock pin 56 is made of a metal material such as steel. The hood pin plunger assembly 54 includes an upper guide 58 fixedly attached to the first hood 40 by suitable means such as welding. The hood pin plunger assembly 54 includes a lower guide 60 fixedly attached to the first hood 40 by suitable means such as welding. The upper guide 58 is spaced vertically from the lower guide 60 and the lock pin 56 extends through aligned apertures in the guides 58 and 60. The lock pin 56 has a flange 62 extending outwardly. The flange 62 is generally circular in shape. The hood pin plunger assembly 54 includes a spring 64 such as a coil spring disposed about the lock pin 56 between the flange 62 and the lower guide 60 to urge an upper end of the lock pin 56 to overlap the flange 52 on the hood pin 44. The hood pin plunger assembly 54 includes a handle 66 extending outwardly from the lock pin 56 to allow as operator to move the lock pin 56 downwardly past the flange 52 of the hood pin 44 by compressing the spring 64 to allow the hood pin 44 to be removed once the padlock 53*b* is removed. The handle 66 is bent 68 at an angle, preferably forty-five degrees, from a distance adjacent to the lock pin 56, preferably one inch, to form a stop so that the handle 66 will not fold inside second hood 42 when closing or moving to the closed position.

The hood assembly 10 also includes a projection 70 extending radially and axially along the shaft 28. The projection 70 has at least one, preferably two inclined sides 72 to move the lock pin 56 upwardly as it rotates. A lower end of the lock pin 56 engages the shaft 28 as it rotates and the projection 70 moves the lock pin 56 upwardly to further overlap the flange 56 of the hood pin 44. The projection 70 is secured to the shaft 28 by suitable means such as welding. It should be appreciated that the projection 70 could be integral and formed as one-piece with the shaft 28.

The hood assembly 10 may include a limit switch 74 or the like at one end of the hood pin 44 to prevent power to the engine when the hood pin 44 is removed.

In operation of the wood chipper 12, the engine 24 rotates the shaft 28 and cutting assembly 20 and feed wheels of the feedwheel assembly 18. Wood is fed into the inlet 16 of the infeed chute assembly 14 by an operator and is contacted by the feedwheel assembly 18 and fed to the cutting assembly 20. As the cutting assembly 20 rotates and contacts the wood, the wood is cut or chipped into wood chips, which move through the outlet of the first hood 40 and are expelled out of the discharge chute 32. The projection 70 on the shaft 28 does not allow the lock pin 56 to be lowered down while the shaft 28 is turning. Thus, the lock pin 56 stops removal of the hood pin 44 because it overlaps the flange 52 as long as the shaft 28 rotates. It should be appreciated that by rotation of the shaft 28, the projection 70 keeps the lock pin 56 upwardly and does not allow the operator to compress the spring 64 and move the lock pin 56 past the hood pin 44 to remove the hood pin 44. It should also be appreciated that there is not enough time between rotation of the projection 70 to compress the spring 64 and remove the hood pin 44.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A hood assembly for a wood chipper comprising:

a housing;

a rotatable cutting assembly partially disposed within said housing;

a first hood partially covering said cutting assembly and fixedly connected to said housing;

a second hood pivotally connected to said housing and having a closed position covering said cutting assembly and an open position extending away from said cutting assembly;

a removable hood pin to connect said first hood and said second hood together in said closed position; and a hood pin plunger assembly connected to said first hood for cooperating with said hood pin and having a bent handle to allow an operator to actuate said hood pin plunger assembly to remove said hood pin after said cutting assembly has stopped rotating to move said second hood to said open position.

2. A hood assembly as set forth in claim 1 wherein said hood pin plunger assembly includes a lock pin engageable with a shaft of said cutting assembly.

3. A hood assembly as set forth in claim 2 wherein said hood pin has a first flange extending outwardly.

4. A hood assembly as set forth in claim 3 wherein said hood pin plunger assembly includes an upper guide attached to said first hood, said lock pin extending through said upper guide and overlapping said first flange.

5. A hood assembly as set forth in claim 4 wherein said hood pin plunger assembly includes a lower guide attached to said first hood and spaced from said upper guide, said lock pin extending through said lower guide and contacting said shaft.

6. A hood assembly as set forth in claim 5 wherein said hood pin plunger assembly includes a second flange extending outwardly from said lock pin and spaced between said upper guide and said lower guide.

7. A hood assembly as set forth in claim 6 wherein said hood pin plunger assembly includes a spring disposed about said lock pin between said second flange and said lower guide to urge an upper end of said lock pin to overlap said first flange of said hood pin.

8. A hood assembly as set forth in claim 1 wherein said handle is bent adjacent said first hood to extend outwardly and away from said first hood.

9. A hood assembly as set forth in claim 1 wherein said shaft includes a projection extending radially and cooperating with said lock pin.

10. A hood assembly as set forth in claim 9 wherein said projection is inclined on at least one side.

11. A hood assembly for a wood chipper comprising:

a lower housing;

a rotatable shaft extending transversely to said lower said housing;

a cutting assembly partially disposed within said lower housing and about said shaft;

a first upper hood partially enclosing said cutting assembly and fixedly connected to said lower housing;

a second upper hood pivotally connected to said lower housing and having a closed position covering said cutting assembly and an open position extending away from said cutting assembly;

a removable hood pin connecting said first upper hood and said second upper hood together in said closed position;

a hood pin plunger assembly engagable with said shaft to prevent said second upper hood from being moved by an operator from said closed position to said open position while said cutting assembly is rotating; and said hood pin plunger assembly comprising a lock pin having a bent handle to allow an operator to actuate said hood pin plunger assembly to remove said hood pin after said cutting assembly has stopped rotating to move said second upper hood to said open position.

12. A hood assembly as set forth in claim 11 wherein said hood pin has a generally L shape.

13. A hood assembly as set forth in claim 11 wherein said hood pin has a first flange extending outwardly.

14. A hood assembly as set forth in claim 13 wherein said hood pin plunger assembly includes an upper guide attached to said first upper hood, said lock pin extending through said upper guide and overlapping said first flange.

15. A hood assembly as set forth in claim 14 wherein said hood pin plunger assembly includes a lower guide attached to said first upper hood and spaced from said upper guide, said lock pin extending through said lower guide and contacting said shaft.

16. A hood assembly as set forth in claim 15 wherein said hood pin plunger assembly includes a second flange extending outwardly from said lock pin and spaced between said upper guide and said lower guide.

17. A hood assembly as set forth in claim 16 wherein said hood pin plunger assembly including a spring disposed about said lock pin between said second flange and said lower guide to urge an upper end of said lock pin to overlap said first flange of said hood pin.

18. A hood assembly as set forth in claim 17 wherein said shaft includes a projection extending radially and cooperating with said lock pin.

19. A hood assembly as said forth in claim 17 wherein said projection includes an incline on at least one side.

20. A hood assembly for a wood chipper comprising:

a lower housing;

a rotatable shaft extending transversely to said lower housing;

a cutting assembly partially disposed within said lower housing and about said shaft;

a first upper half hood partially enclosing said cutting assembly and fixedly connected to said lower housing;

a second upper half hood pivotally connected to said lower housing and having a closed position covering said cutting assembly and an open position extending away from said cutting assembly;

a removable hood pin connecting said first upper half hood and said second upper half hood together in said closed position; and a lock pin engagable with said shaft to prevent said second upper half hood from being moved by an operator from said closed position to said open position while said cutting assembly is rotating and having a bent handle to allow an operator to actuate said lock pin.

* * * * *